US008859107B2

(12) United States Patent
Scarinci

(10) Patent No.: US 8,859,107 B2
(45) Date of Patent: Oct. 14, 2014

(54) FORMWORK SPACER AND TIE USED AS AN ANCHOR FOR CONCRETE CONSTRUCTION

(76) Inventor: Domenico Scarinci, Guildford (AU)

( * ) Notice: Subject to any disclaimer, the term of this patent is extended or adjusted under 35 U.S.C. 154(b) by 37 days.

(21) Appl. No.: 13/376,838

(22) PCT Filed: May 14, 2010

(86) PCT No.: PCT/AU2010/000563

§ 371 (c)(1),
(2), (4) Date: Dec. 7, 2011

(87) PCT Pub. No.: WO2010/144942

PCT Pub. Date: Dec. 23, 2010

(65) Prior Publication Data

US 2012/0079787 A1 Apr. 5, 2012

(30) Foreign Application Priority Data

Jun. 19, 2009 (AU) ..... 2009902949
Jul. 2, 2009 (AU) ..... 2009903091

(51) Int. Cl.
*E04B 1/38* (2006.01)
*E04G 17/065* (2006.01)
*E04G 11/06* (2006.01)

(52) U.S. Cl.
CPC ..... *E04G 17/0654* (2013.01); *E04G 11/06* (2013.01); *E04G 17/0658* (2013.01); *E04B 1/38* (2013.01); *E04G 17/065* (2013.01)
USPC ..... 428/598; 52/699; 52/707; 52/831; 249/42; 249/216

(58) Field of Classification Search
CPC ..... F16S 3/00; E04C 3/00; E04B 1/38; E04B 1/40; E04B 1/41; E04B 1/4114; E04B 1/4121; E04G 11/06; E04G 11/08; E04G 17/04; E04G 17/042; E04G 17/06; E04G 17/065; E04G 17/0651; E04G 17/0654; E04G 17/0655; E04G 17/0658
USPC ..... 249/42, 43, 216, 217; 52/831, 833, 698, 52/699, 704, 707; 428/598, 600
See application file for complete search history.

(56) References Cited

U.S. PATENT DOCUMENTS 2,101,141 A * 12/1937 Hungerford ..... 269/196
3,830,033 A * 8/1974 Gahler ..... 52/831
4,858,405 A * 8/1989 Christie ..... 52/208
5,896,718 A * 4/1999 Westgarth ..... 52/646

FOREIGN PATENT DOCUMENTS

JP H08284409 A * 10/1996 ..... E04G 17/02

* cited by examiner

*Primary Examiner* — Michael Safavi
(74) *Attorney, Agent, or Firm* — Molins & Co Pty Ltd

(57) ABSTRACT

A device for use with formwork in concrete construction. The device comprising: a body having a bore for defining a first aperture; one or more sidewalls coupled to the body, the sidewalls extending upwardly outwardly with respect to the body; wherein, when the body is releasably coupled to the formwork, the bore is adapted to receive a formwork coupling element. The device can be incorporated into concrete structures within building.

14 Claims, 15 Drawing Sheets

FORMWORK SPACER AND TIE USED AS AN ANCHOR FOR CONCRETE CONSTRUCTION

FIELD OF THE INVENTION

The present invention relates to building construction and in particular to concrete building construction.

The invention has been developed primarily for use with bracing ties in the construction of a site-erected concrete-filled wall and will be described hereinafter with reference to this application. However, it will be appreciated that the invention is not limited to this particular field of use.

BACKGROUND OF THE INVENTION

Any discussion of the prior art throughout the specification should in no way be considered as an admission that such prior art is widely known or forms part of the common general knowledge in the field.

The construction of concrete walls in high rise buildings is typically time consuming and expensive. There is a need in the art for improved apparatus for, and respective methods of, constructing concrete walls.

OBJECT OF THE INVENTION

It is an object of the present invention to overcome or ameliorate at least one of the disadvantages of the prior art, or to provide a useful alternative.

It is an object of the invention in its preferred form to provide a device for use as an adaptor, spacer and/or tie in concrete construction formwork.

SUMMARY OF THE INVENTION

According to the invention there is provided a device for use with formwork in concrete construction, the device comprising:

a body having a bore for defining a first aperture;

one or more sidewalls coupled to the body, the sidewalls extending upwardly outwardly with respect to the body;

wherein, when the body is releasably coupled to the formwork, the bore is adapted to receive a formwork coupling element.

Preferably the device further comprises a substantially planar base portion for engaging a surface of formwork. More preferably, the device further comprises a first fastening element for releasably fastening the device to the formwork. Most Preferably, the first fastening element includes a plurality of apertures for receiving nails to releasably fastening the device to a substantially horizontal portion of formwork.

Preferably, each sidewall has a peripheral outwardly extending flange. More preferably, the device comprising three interconnected sidewalls located proximal to three sides of the body.

Preferably, the bore extends axially into the body and is adapted for threaded engagement with a threaded rod or bolt.

Preferably, the bore defines a first aperture at a first end of the body, the device comprising a second aperture at a second end of the body. More preferably, the bore defines the second aperture. Most preferably, the first aperture defines a second fastening element for releasably fastening the device to formwork, and the second aperture is adapted for receiving the formwork coupling element.

Preferably, the device further comprises a protrusion for abutting engagement with a corner or an edge of formwork.

Preferably, the device is integrally formed. More preferably, the device is constructed from plastics. Most preferably, the device is used in formwork for concrete construction.

Preferably the device is in combination with a building comprising concrete, wherein the device is substantially encapsulated in the concrete.

Preferably, the device can be used as an anchor point when set in concrete.

According to the invention there is provided a building comprising concrete, the building including one or more devices as herein described.

According to the invention there is provided a building comprising concrete, the building including a device comprising:

a body having a bore for defining a first aperture;

one or more sidewalls, the sidewalls extending upwardly outwardly with respect to the body;

wherein, when the body is releasably coupled to the formwork, the bore is adapted to receive a formwork coupling element.

BRIEF DESCRIPTION OF THE DRAWINGS

A preferred embodiment of the invention will now be described, by way of example only, with reference to the accompanying drawings in which.

PREFERRED EMBODIMENT OF THE INVENTION

Figure 1A:
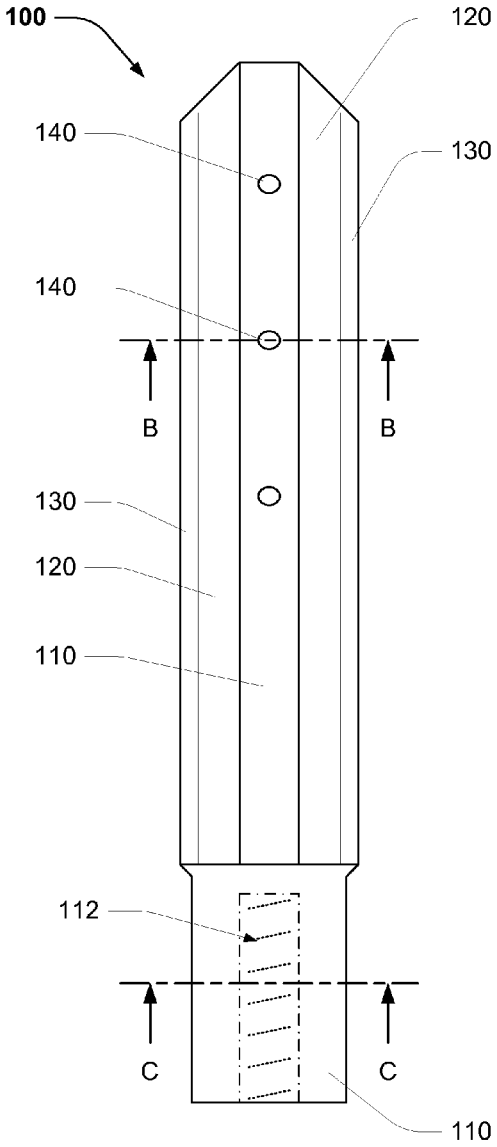
FIG. 1A is a plan view of a device according to the invention.
Figure 1B:
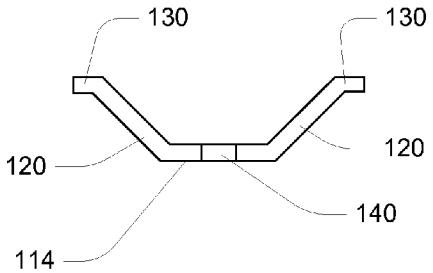
FIG. 1B is a sectional elevation view of the device of FIG. 1A, taken along line B-B of FIG. 1A.
Figure 1C:
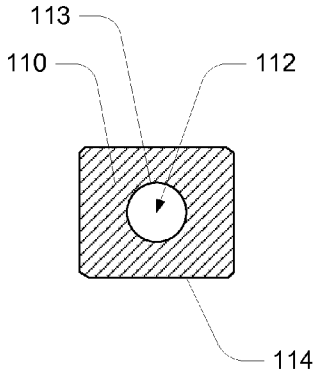
FIG. 1C is a sectional elevation view of the device of FIG. 1A, taken along line C-C of FIG. 1A.

FIG. 1A, FIG. 1B and FIG. 1C shows an embodiment device 100 used to hold formwork for use with concrete construction. The device 100 is substantially rectangular in plan view and comprises:

a body 110 having a bore 112 for defining a first aperture 113;

one or more sidewalls 120 extending upwardly outwardly in respect of the body 110.

wherein, when the body is releasably coupled to formwork, the bore is adapted to receive a formwork coupling element.

In this example embodiment, each sidewall 120 has a peripheral outwardly extending flange 130. The body further defines a substantially planar base portion 114 for engaging a surface of formwork. The device can further include a first fastening element 140 for releasably fastening the device to formwork (not shown). The first fastening element 140 is typically in the form of apertures for receiving nails to releasably fastening the device to a substantially horizontal portion of formwork. Preferably, the nails can be pulled through the body as, or when, the formwork is removed. The device is typically integrally formed.

In this example embodiment, the bore 112 is a 12 mm threaded bore extending axially through the body for receiving a thread rod. The bore is typically centrally located about a centre portion of an end face of the device and is at least 80 mm deep.

In use the device 100 can be fixed to a top of a deck portion of formwork at selected measurement from a structure. Typically, the device can be fixed at one end by nails to the top of the deck, at selected measurement from an upright wall or edgeboard. The device can also be used to hold on an edgeboard outside bricks or concrete block, or overhang structures outside bricks or blocks (typically up to 150 mm). This device can be selectively fixed to hold top of walls, upturns and edgeboards in a substantially straight alignment.

It will be appreciated that the device 100 can be made in different lengths as required. Preferably the device can be made of plastics, but other material such as metals (including steel) can be used. Use of steel is less preferred for use in wet areas due to its susceptibility to rust. Preferably, the device can be made in plastics of ash grey in colour to better match the colour of concrete. This device colour selection is preferred for exposed balcony soffit rooms, where no false ceiling are to be installed, car parks, or proximal to a wet area.

It will be further appreciated that the device 100 can be used in a plurality of configurations, including:

As split level formwork;

Upturn walls; and/or

Edgeboard etc.

Figure 13:
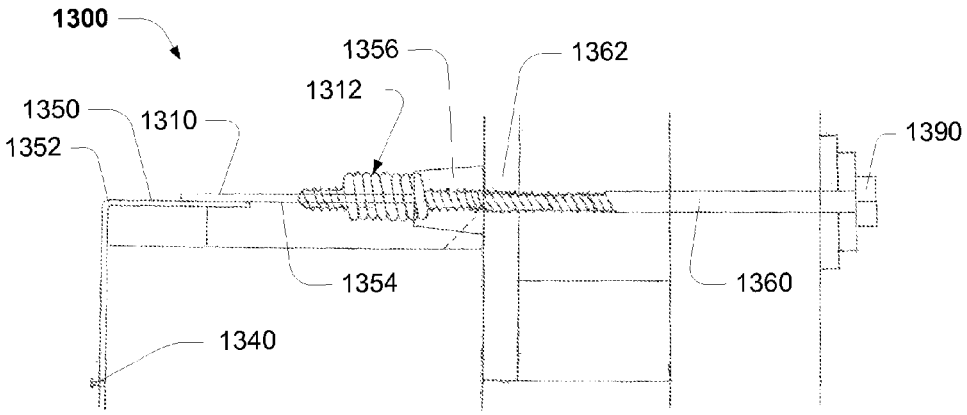
FIG. 13 is a side elevation of a device according to the invention.

By way of example, as best shown in FIG. 13, the device 1300 can be conducted of metal and comprise:

a body 1310 having a bore 1312 for defining a first aperture;

one or more sidewalls 1320 extending upwardly outwardly in respect of the body 1310.

wherein, when the body is releasably coupled to formwork at 1340, the bore is adapted to receive a formwork coupling element 1390.

It will be appreciated that, in this example, flat steel bar 1350—25 mm wide×3 mm thick×320 long—can be used. This bar can be bent (at 1352) to provide sufficient portion to engage a soil spring element 1354. A plastic cone 1356 (for example 35 mm) can be connected to the end of the coil spring. The device can be fitted to the formwork (or existing masonry block work) by a nail or screw at 1340. A bolt 1360 can be used to fix the plywood 1360 formwork to the device.

Figure 2A:
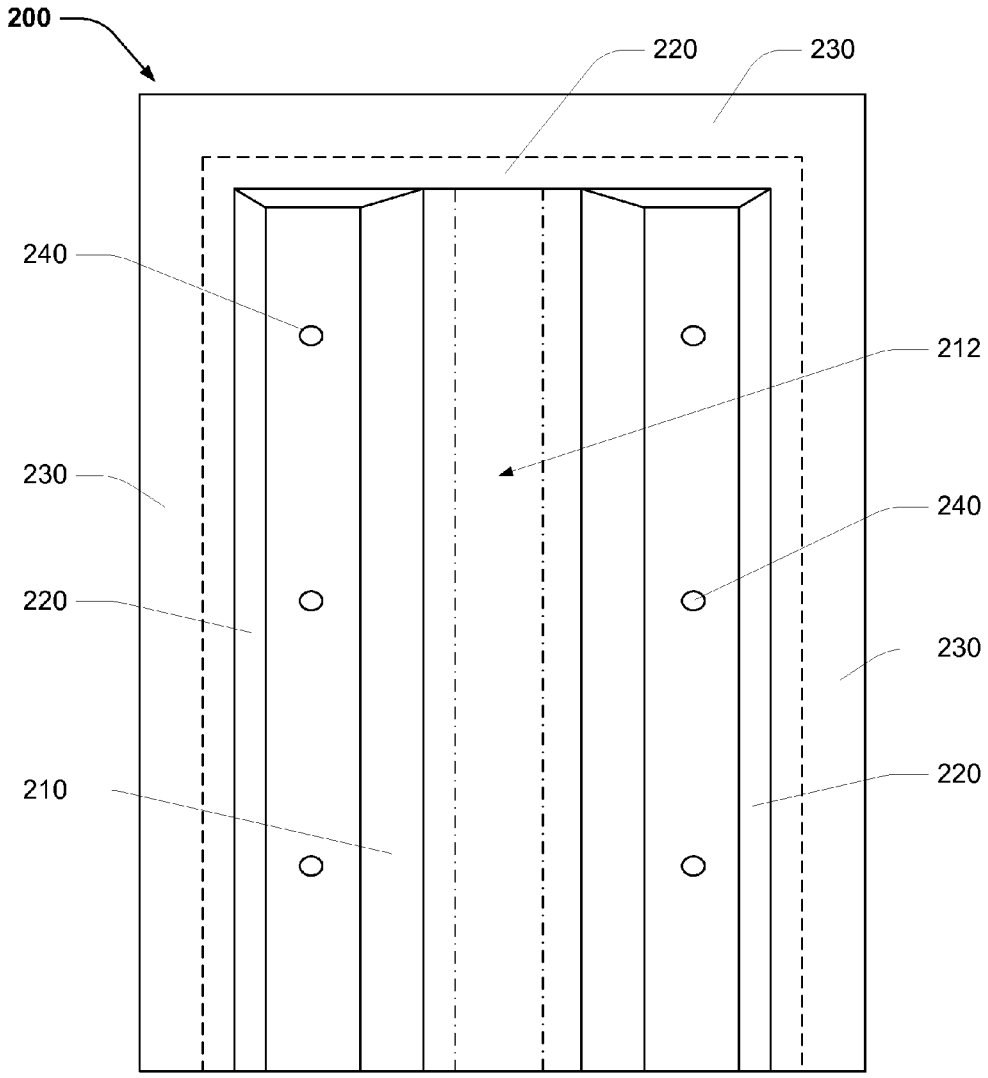
FIG. 2A is a plan view of a device according to the invention.
Figure 2B:
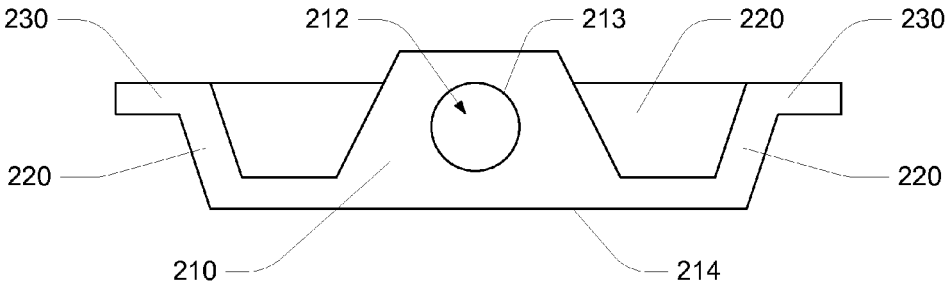
FIG. 2B is an elevation view of the device of FIG. 2A.

FIG. 2A and FIG. 2B show an embodiment device 200 used to hold formwork for use with concrete construction. Particularly, the device is adapted to hold the formwork from a top part of the deck on a split level. The device 200 can further be used in combination with the device 100 for holding formwork.

This example embodiment device 200 is substantially rectangular in plan view and comprises:

a body 210 having an bore 212 for defining a first aperture 213;

one or more sidewalls 220 extending upwardly outwardly in respect of the body 210;

wherein, when the body is releasably coupled to formwork, the bore is adapted to receive a formwork coupling element.

In this embodiment, by way of example only, each sidewall 220 has peripheral outwardly extending flange 230. The sidewalls and flange are typically interconnected, and can be formed across three or more sides of the body. The device is typically integrally formed.

In an embodiment, the body can further define a substantially planar base portion 214 for engaging a surface of formwork. The device can further include a first fastening element 240 for releasably fastening the device to formwork (not shown). The first fastening element 240 is typically in the form of apertures for receiving nails to releasably fastening the device to a substantially horizontal portion of formwork. Preferably, the nails can be pulled through the body as, or when, the formwork is removed.

In an embodiment, by way of example only, the device 200 is substantially rectangular in plan view, being 110 mm long and 72 mm wide. An axis is defined down the length of the device. A base is 55 mm wide and 5 mm thick. Three interconnected side elements (or sidewalls) extend upwardly outwardly from the perimeter of the base, the side elements being 15 mm high and 3.5 mm thick. A peripheral outwardly extending flange is provided at the periphery of each side element, the flange being 3.5 mm thick and 3.5 mm wide. The peripheral side element and the flange assist the device to remain cast in concrete as (or when) formwork is removed. A body element is located atop the base, the body element is 25 mm thick, 25 mm wide and extends axially substantially the length of the base. A 12 mm threaded bore extends axially through the body for receiving a coil spring thread rod, The bore is typically centrally located with the end face of the device and is at least 80 mm deep.

Referring to FIG. 3A through FIG. 3F, an alternative embodiment device 300 (similar to device 200) is shown.

This example embodiment device 300 is substantially rectangular in plan view and comprises:

a body 310 having an bore 312 for defining a first aperture 350 at a first end 352 of the device;

a plurality of sidewalls 320 extending upwardly outwardly in respect of the body 310.

wherein, when the body is releasably coupled to formwork, the bore is adapted to receive a formwork coupling element.

In this embodiment, by way of example only, each sidewall 320 has a peripheral outwardly extending flange 330. The sidewalls and flange are typically interconnected and can be formed across three or more sides of the body. The device is typically integrally formed.

In an embodiment, the body can further define a substantially planar base portion 314 for engaging a surface of formwork. The device can further include a first fastening element 340 for releasably fastening the device to formwork (not shown). The first fastening element 340 is typically in the form of apertures for receiving nails to releasably fastening the device to a substantially horizontal portion of formwork. Preferably, the nails can be pulled through the body as, or when, the formwork is removed.

In this example embodiment, the bore 312 defines a first aperture 350 at a first end of the body 352. A second aperture 360 is defined at a second end of the body 362. The second aperture 360 is typically defined by the bore 312.

In an embodiment, the bore is a 12 mm threaded bore extending axially through the body for receiving the threaded rod. The bore is typically located about the centre of with the first and second end face of the device (352 and 362), and extending there through. One or both end faces are preferably substantially planar and perpendicular to the axis of the bore, for facilitating abutting engagement with a substantially vertical portion of formwork. When the device is set in concrete, a transverse portion 380 of the sidewalls 320 located within the concrete assists in restricting axial movement. The first aperture 350 can define a second fastening element for releasably fastening the device to formwork. The second fastening element is typically used for releasably fastening the device to a substantially vertical portion of formwork. The second aperture 360 is adapted to receive a formwork coupling element. A formwork coupling element can include a tie (for example a coil spring tie).

In this embodiment, as the bore 312 defines the first aperture 350 and the second aperture 360 (at the first end 352 and second end 362 of the body respectively), either end can be adapted for abutting engagement with a substantially vertical portion of formwork. In this example, a threaded bolt can be used to pass through the formwork and into the bore to releasably fix (or couple) the device to the substantially vertical portion of formwork.

While the bore 312 is preferably a through bore, an embodiment can comprise two bores, thereby defining a respective first aperture 350 and the second aperture 360.

In an embodiment, the device can include a protrusion 370, which extends from the planar base portion 314. This protrusion is located such that it can make abutting engagement with a corner or an edge of formwork. This protrusion is adapted to locate the respective end at a predetermined distance past the corner or an edge of formwork.

Figure 3A:
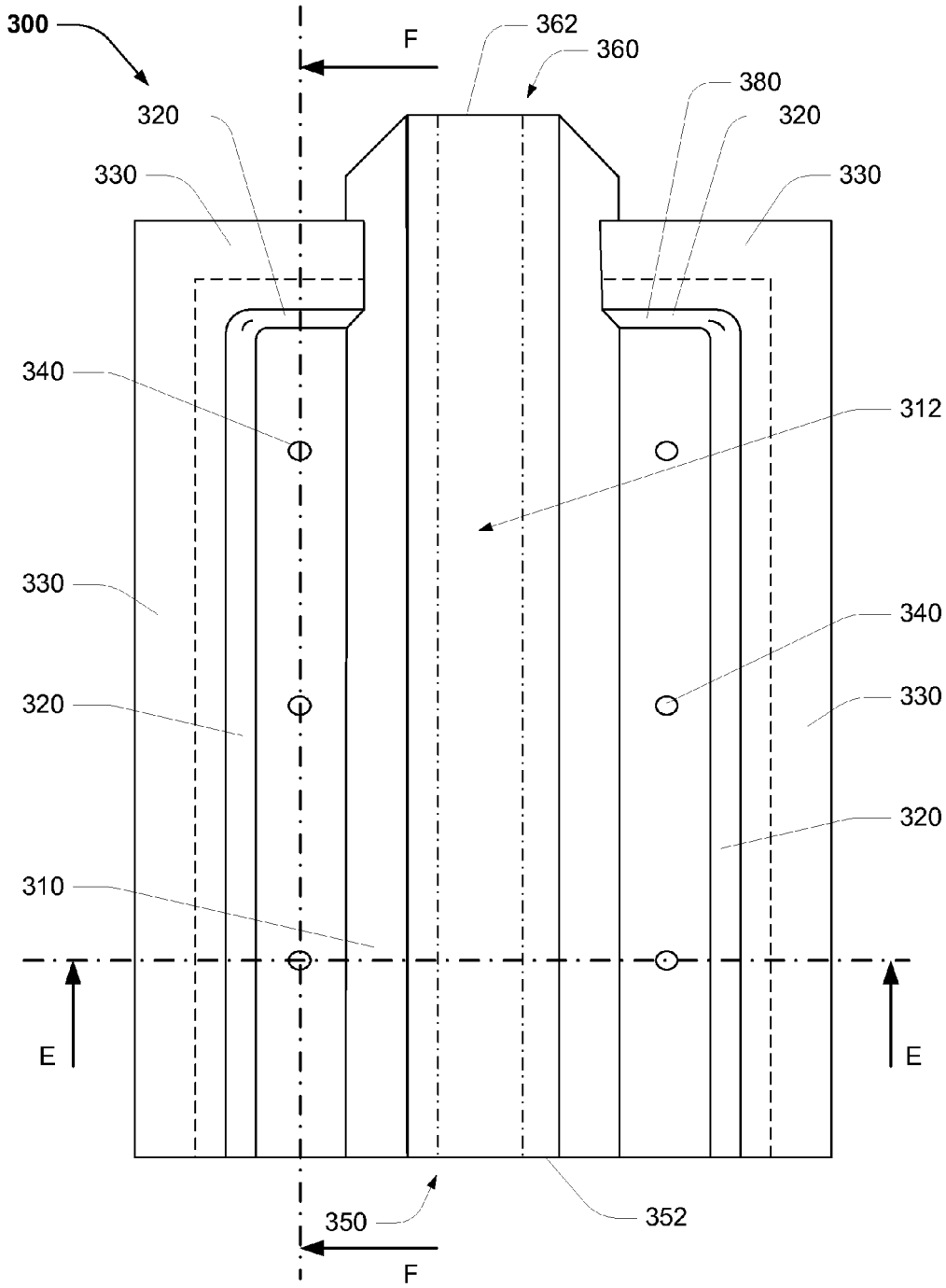
FIG. 3A is a plan view of a device according to the invention.
Figure 3B:
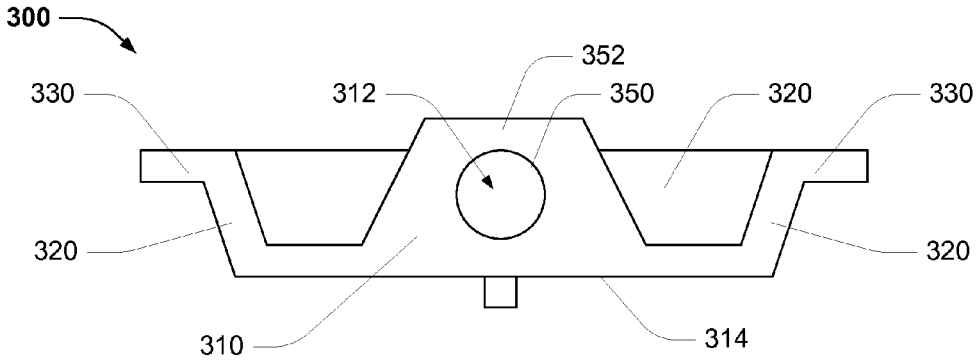
FIG. 3B is an front elevation view of the device of FIG. 3A.
Figure 3C:
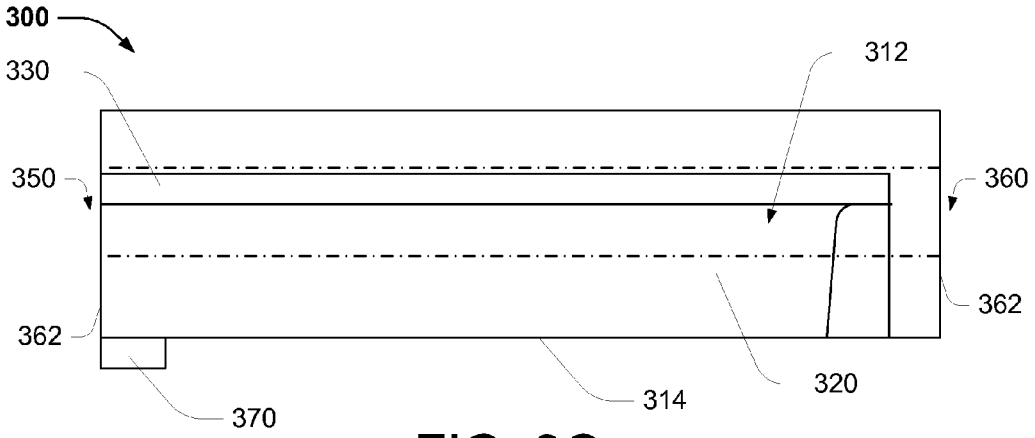
FIG. 3C is an side elevation view of the device of FIG. 3A.
Figure 3D:
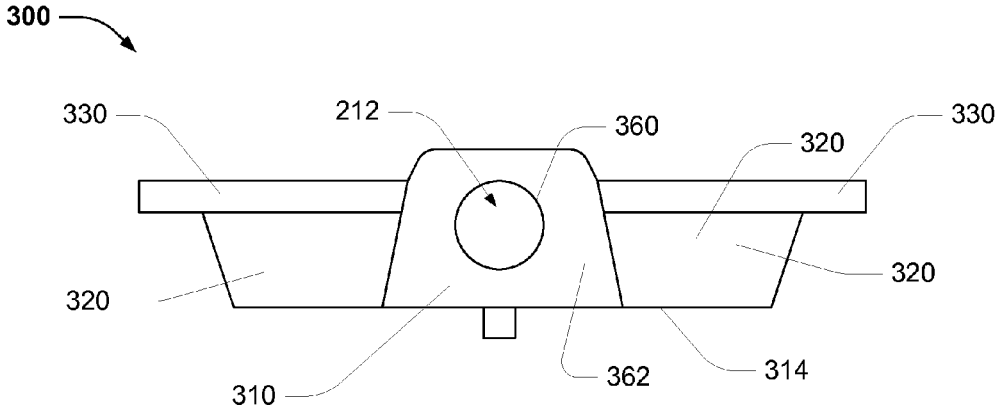
FIG. 3D is an rear elevation view of the device of FIG. 3A.
Figure 3E:
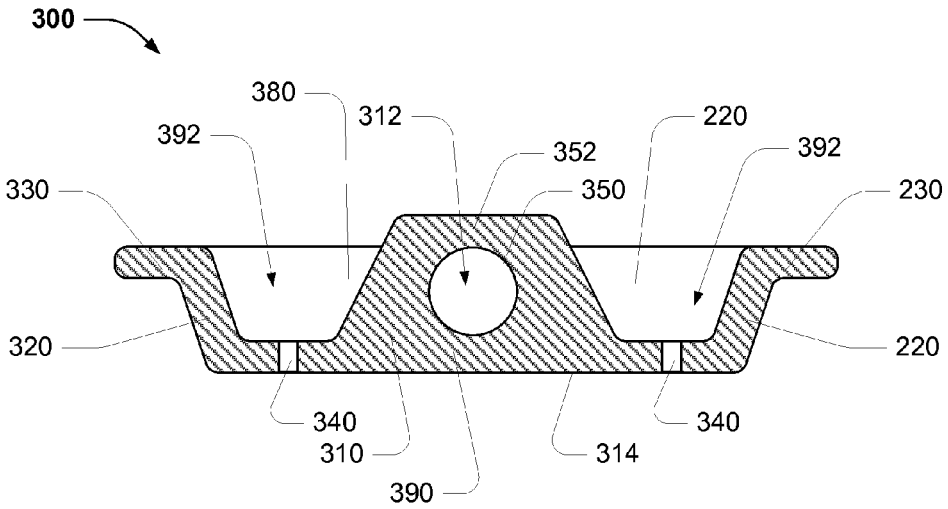
FIG. 3E is a sectional elevation view of the device of FIG. 3A, taken along line E-E of FIG. 3A.

FIG. 3E shows a transverse sectional view of the device 300. This view shows that the body includes a core component 390 having the bore 312 extending longitudinally there through. The core component is located between a pair of upwardly outwardly extending sidewalls 320, to thereby define respective channels 392 there between. The first fastening element 340 is in the form of apertures for receiving nails to releasably fastening the device to a substantially horizontal portion of formwork. Preferably, the nails can be pulled through the body as, or when, the formwork is removed—without dislodging the device from concrete.

Figure 6:
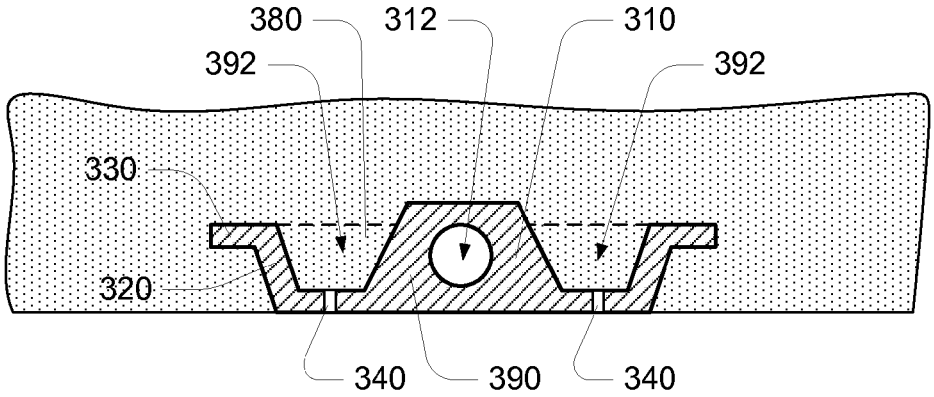
FIG. 6 is a sectional front elevation of a device according to the invention, shown contained in concrete.

It will be appreciated that when the device is installed in concrete the base portion 114 exposed within a surface of the concrete. The outwardly extending sidewalls 320 and flange 330 are encased in concrete to assists in restricting downward vertical movement of the device, as best shown in FIG. 6.

Figure 3F:
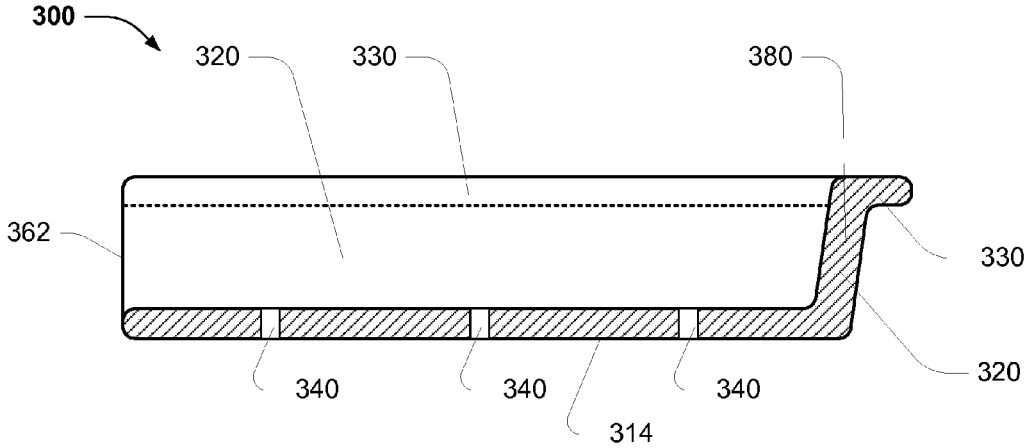
FIG. 3F is a sectional elevation view of the device of FIG. 3A, taken along line F-F of FIG. 3A.

FIG. 3F shows a longitudinal sectional view taken through the channel 390 defined between the body 310 and the side wall 320.

Figure 7:
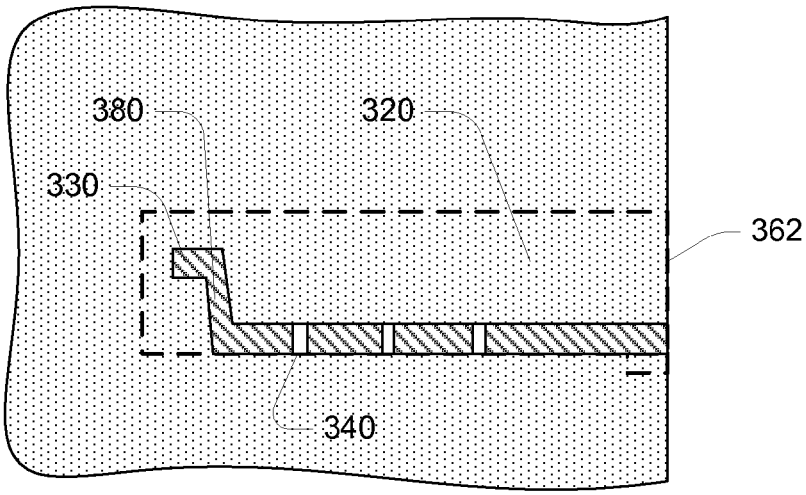
FIG. 7 is a sectional side elevation of a device according to the invention, shown contained in concrete.
Figure 8A:
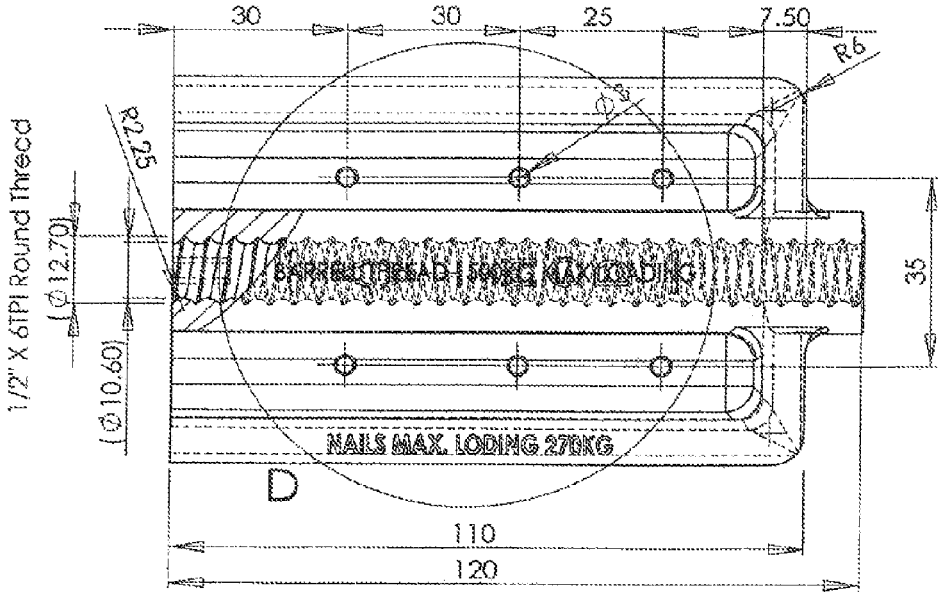
FIG. 8A is a plan view of a device according to the invention.
Figure 8B:
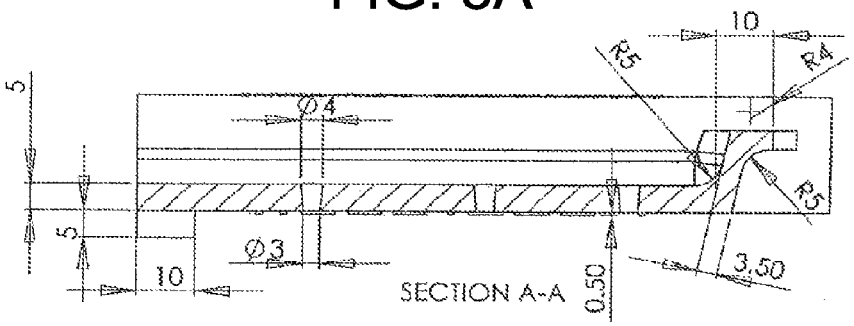
FIG. 8B is sectional side elevation view of the device of FIG. 8A.
Figure 8C:
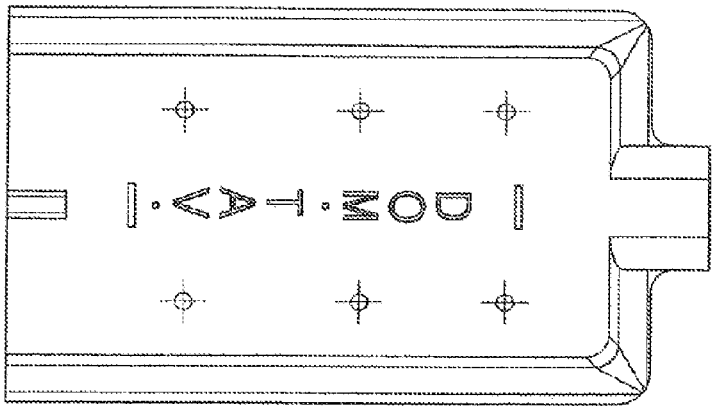
FIG. 8C is an underside view of the device of FIG. 8A.
Figure 8D:
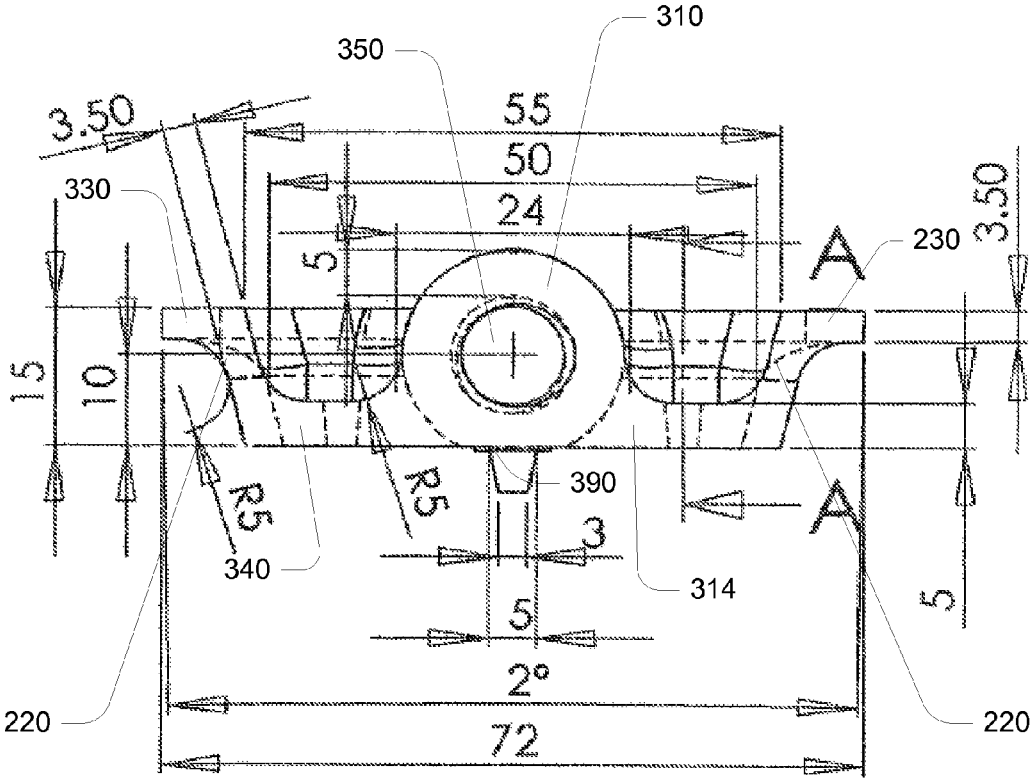
FIG. 8D is an front elevation view of the device of FIG. 8A.

It will be appreciated that when the device is installed in concrete, an end can be exposed within the face of a wall, for example the second end of the body 362. The transverse portion 380 of the sidewalls 320 can assist in restricting axial movement, as best shown in FIG. 7.

Figure 4A:
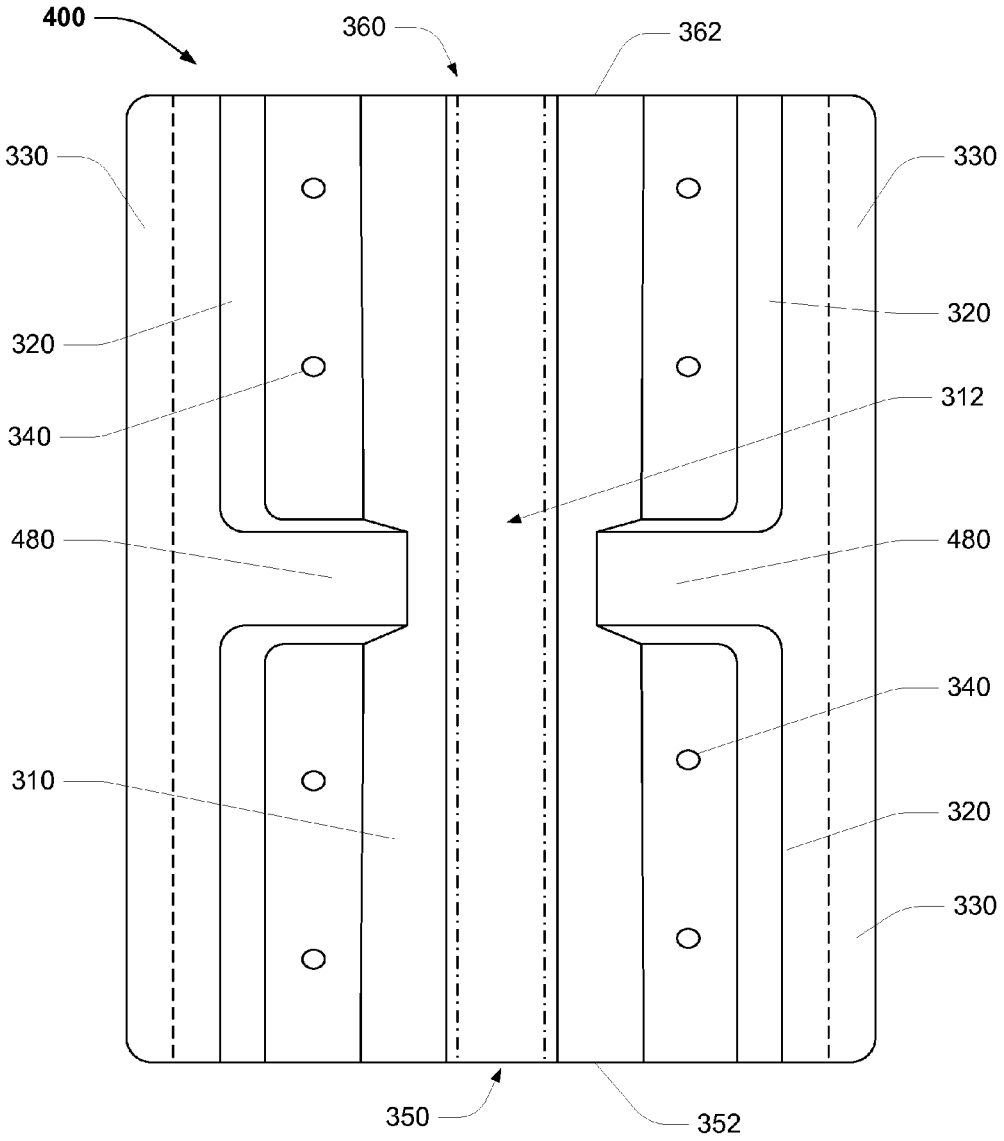
FIG. 4A is a plan view of a device according to the invention.
Figure 4B:
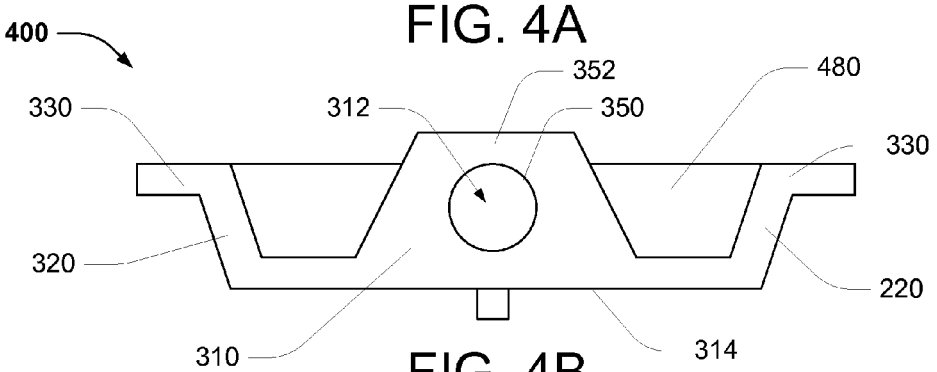
FIG. 4B is an front elevation view of the device of FIG. 4A.

As best shown in FIGS. 4A and 4B, a device can include a first end 352 and a second end 362, wherein either is adapted for abutting engagement with portion of formwork. In this example a webbing element 480 can be included for restricting axial movement when the device is set in concrete.

It will be appreciated that these devices (100, 200, 300 and 400) can be placed (or fixed) in position before commencing substantive steel works. These devices are relatively easy, safe and quick to position. These devices can be fixed in position, for example by nails at the edge of the top soffit split level formwork. Preferably, a plurality of 2.8 mm×50 mm jolt head nails (for example four or more) can be used to fix the devices in position. The disclosed devices can be used as a spacer and tie for holding formwork, and can be fixed into position before any respective steel work is placed. The devices can hold formwork upturn from top soffit of split level.

In an embodiment, the devices can be comprised of plastics and/or integrally formed. Typically, as the device can be exposed at faces of the concrete, the plastics can be coloured to best match the concrete.

Figure 5A:
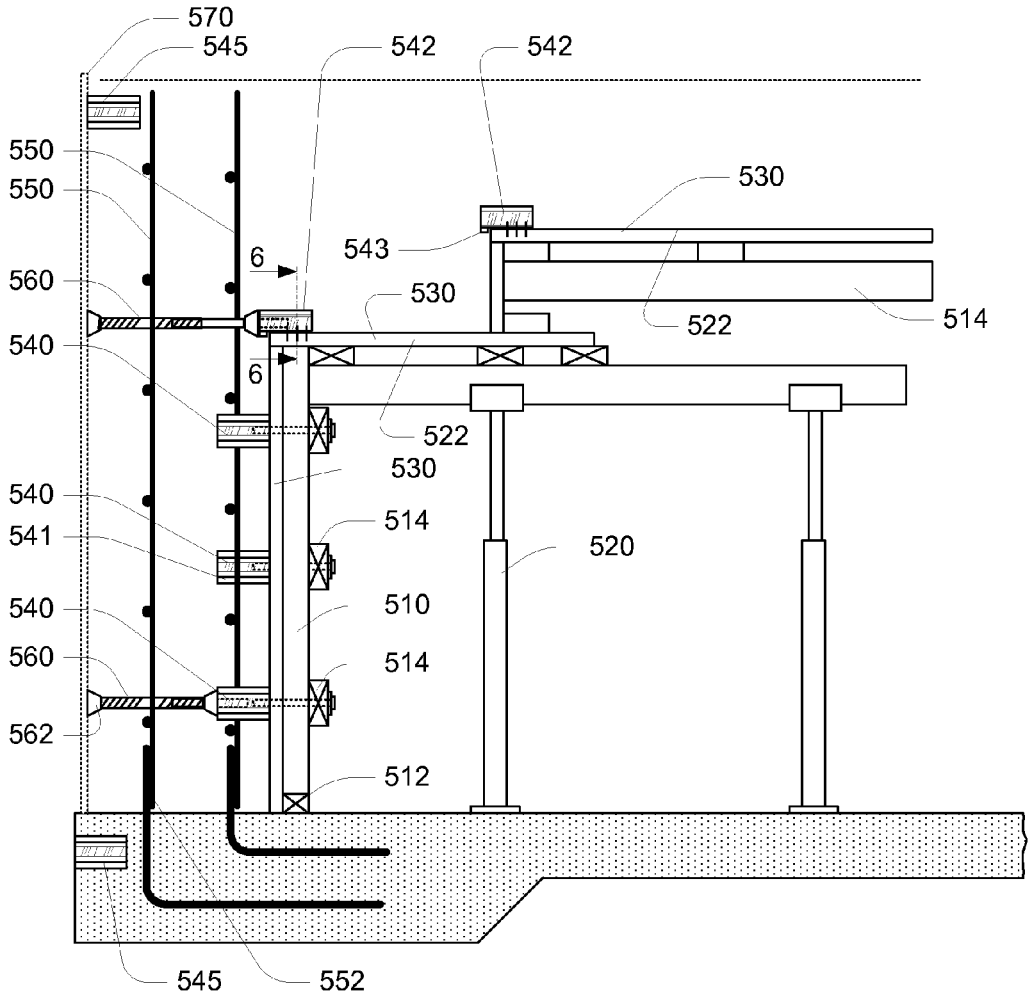
FIG. 5A is a construction view of concrete formwork using one or more devices according to the invention.

FIG. 5 shows devices (100, 200, 300 and 400) used as spacers and ties in holding formwork for use with concrete construction.

The wall assembly framework typically comprises a timber frame including studs 510 and battens 512 (typically fixed into concrete) and horizontal members 514 (used to support the wall). For defining a suspended concrete beam, scaffolding in the form of U-Jacks 520 can be used to support the soffit 522. Plywood sheeting 530 (for example 17 mm thick plywood sheet) is then typically used to define a surface over the framework.

With the framework in place, the devices 540 (for example devices 300 or 400) can be fixed to the vertical portions of the plywood sheeting. For example a 15 mm hole can be made through horizontal members 514 the and devices fixed by a formwork bolt (for example 215 mm long). A steel plate washer can be used in a conventional manner.

The device 540, when using device 300, is preferably orientated such that the protrusion 370 is located proximal to the inside face of the formwork walls.

The devices 300 or 400 can be used alone to space out walls (for example matching the length of the device such as 120 mm). Wider walls can be formed by using the device for further adapting ties. For example, the shortest commercially available Coil Spring Tie is used for 250 mm walls, whereas the longest commercially available Coil Spring Tie is 600 mm. It will be appreciated that the disclosed devices can be used for bracing edgeboard, beam side, etc.

With the framework in place, the devices 542 (for example devices 300 or 400) can be fixed in a beam soffit. In this example, a projection (typically 5 mm×5 mm×10 mm) assists in locating the device such that there is no interference with the steel work cover. The device 542 can be used on different levels. When the position is correct 6 nails can be used to releasably couple the device to the plywood. To enable a preferred fixing, the nails are to be completely driven into the device, with the head of the nail level to the inside part of the device. By way of example, the nail type used can include a KOALA MANUFACTURED 30×2.8 Jolt Head Nail or similar.

Further devices 545 (for example devices 100, 200, 300 or 400) can be fixed to exterior portion of the framework such that they may be used for future formwork when continuing a wall or column (such as in a multi story building), or any other anchoring use.

When finalising the steelwork and formwork, the devices are fixed at one side. The steel mesh 550 can be located with the devices in place. The steel mesh can be fixed to existing starter bars 552. The ties (for example coil spring ties 560) can then be fixed to the device through the mesh, and installed with plastic cones 562 as typically used in the art. The plywood sheet 570 can than then be used to form the side.

In use, when the steel work and the devices (as described herein) are in place, coil spring ties can be installed in the formwork. By way of example,

- cut one or more lengths of coil spring thread rod (for example about 120 mm long);
- select suitably sized tie (e.g. coil spring tie);
- engage one end of one of the lengths of threaded rods inside the coil spring tie, exposing about 5 mm of the rod through to the back of spring;
- tack weld the rod inside back portion of the spring;
- threadedly engage the other end the rod within the bore of the device.

It will be appreciated that a person fixing the steel can perform their job without removing any of the devices, and can move the steel mesh horizontally within the wall space without any interference.

The device is used as a anchor The threaded engagement provided within the bore can be made sufficiently strong. The devices can be used as shown in FIG. 5, or in different constructions as a anchor.

Figure 5B:
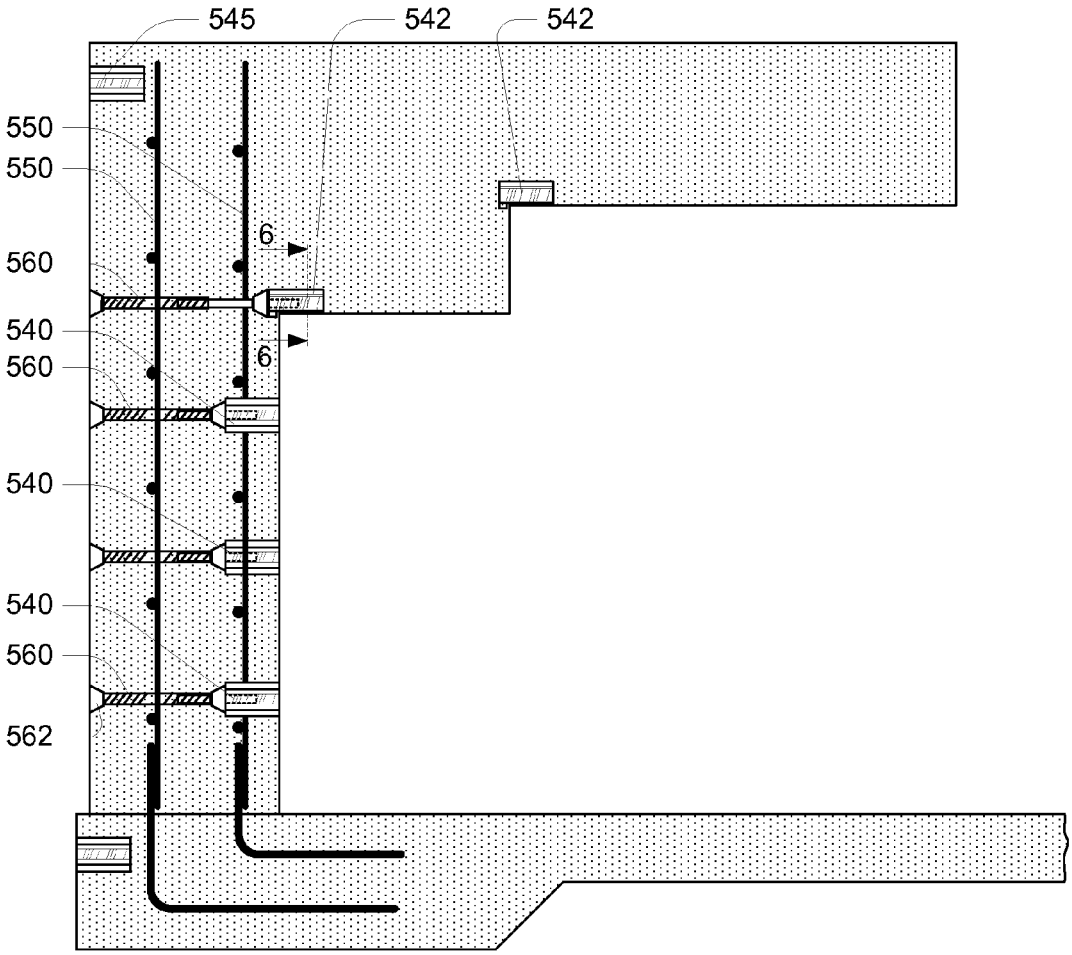
FIG. 5B is a constructed view of a concrete formation incorporating one or more devices according to the invention.

The cement can be poured into the cavity defined by the formwork. Once the cement has cured and the formwork removed, the resultant concrete wall is as shown in FIG. 5B.

It will be appreciated the devices can remain in the concrete walls. Further, construction can results with the base coincident with the surface of the concrete (as shown in FIG. 6), or one end of the device coincident with the surface of the concrete (as shown in FIG. 7)

The disclosed device is a multiuse adaptor, spacer and tie. The device can be made in plastics such that it is rust proof, but can also be made in metal (or steel) or any other type of material. The device is substantially rectangular but can be constructed in different shapes to better to suit different applications in concrete construction. The strength of threaded engagement within the bore can be selected to suit the concrete construction.

These devices can be used in many ways and many types of formwork, such as split level, edgeboard, walls, stepdown, as a anchor, etc. The devices can be encased in concrete at the face of structural building as an anchor point or hanger point or where required. These anchor points can also be used for installing temporary balustrade, bracing, scaffolding.

FIG. 8A through 8D show a dimensioned embodiment of a device (shown in millimeters).

As marked on the device, the threaded engagement is adapted for loading up to 1500 kg. The height of the device is preferably between 15 and 25 mm, which enables a bottom line of steelwork to be located free of the top of the device. The cured end to the channel can provide added material proximal to the threaded portion of the body and thereby enable additional strength to the thread engagement.

A protrusion from the planar base portion being preferably about rectangular shape 5 mm×5 mm in cross section and 10 mm long, for using to the edge of plywood formwork to abut a top corner thereof. This enables relatively quick set up position while maintaining constant straight lines installation. When used in split level or any other corner in soffit of formwork assembly the device can be correctly positioned. Typically, the device can utilise the protrusion with high corner edges in the formwork construction, or on an inside top corner portion of split level formwork, or on an inside corner edges of a beam, or on top corner portion of an inside wall edges.

When fixing the device to a horizontal portion of formwork, six 30×2.8 jolt head nails can be driven through six apertures in the device. These nails are to be driven in completely to provide a full strength fixing of the device in place. As noted on the device, if the nails have been fixed correctly, a max loading 279 kg is enabled. The sidewalls and flange are adapted to restrict movement of the device when removing formwork. The apertures for the nails can be frustoconical in shape, and adapted to enable a nail (and nail head) to be pulled through the body as the formwork is removed from beneath the device—while the device is retained within the concrete.

The thread bore hole is about 12.5 mm in diameter and adapted to receive a bolt extending longitudinally through the body, such as Acrow-Toby or Boral bolts 12.5 mm for a Coil Spring tie. It will be appreciated that the bore can be adapted for receiving other bolt and rod sizes. The threaded through bore enables bolts to be threadedly engaged to the body on (or from) both sides—thereby to suit different applications on building sites. The height of the device is preferably restricted to 25 mm, as to not interfere with the minimum cover on steel placement. For example, N12 reinforcement can be placed over the device.

The correct spacing distance utilises selected 12.5 mm formwork bolts.

Figure 9A:
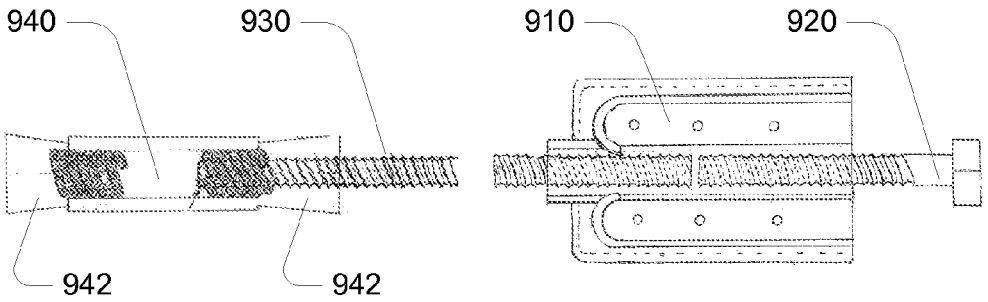
FIG. 9A is a plan view of a device according to the invention, shown threadedly engaged to a bolt and tie.
Figure 9B:
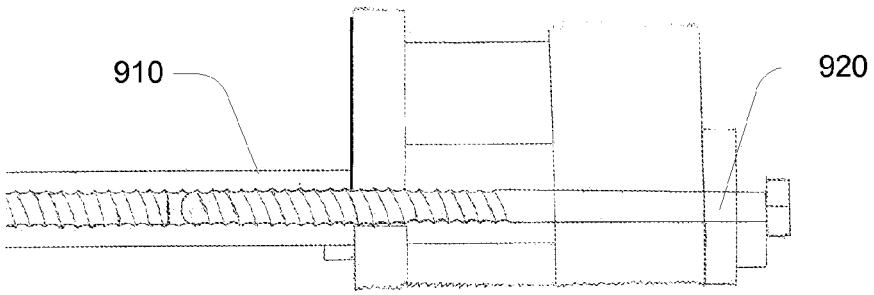
FIG. 9B is a side elevation view of the device of FIG. 9A, shown in use.

FIG. 9A and FIG. 9B shows an as assembled device 910 with tie. A bolt 920 from the formwork face are engaged to the device. A thread rod 930 which has been cut at the correct size of 120 mm long and connected to the coil spring tie 940 (for example a C150), is further engaged at the other side of the device. In this instance plastic cones 942 (for example 35 mm or 25 mm) are coupled to the tie 940. With the bolt and threaded rod engaging the device, a 4 mm gap is preferably retained there between.

A method of providing the rod and tie can include the steps of:

- cut one or more lengths of coil spring thread rod (for example about 120 mm long);
- select suitably sized tie (e.g. coil spring tie);
- engage one end of one of the lengths of threaded rods inside the coil spring tie, exposing about 5 mm of the rod through to the back of spring;
- tack weld the rod inside back portion of the spring.
- threadedly engage the other end the rod within the bore of the device.
- plastic cones are added at ends of the tie to provide the correct size/length (e.g. 35 mm or 25 mm plastic cone)
- providing a 25 mm plastic cone to other side of the spring tie to suit the wall (for a system 250 mm minimum thickness).

Figure 10:
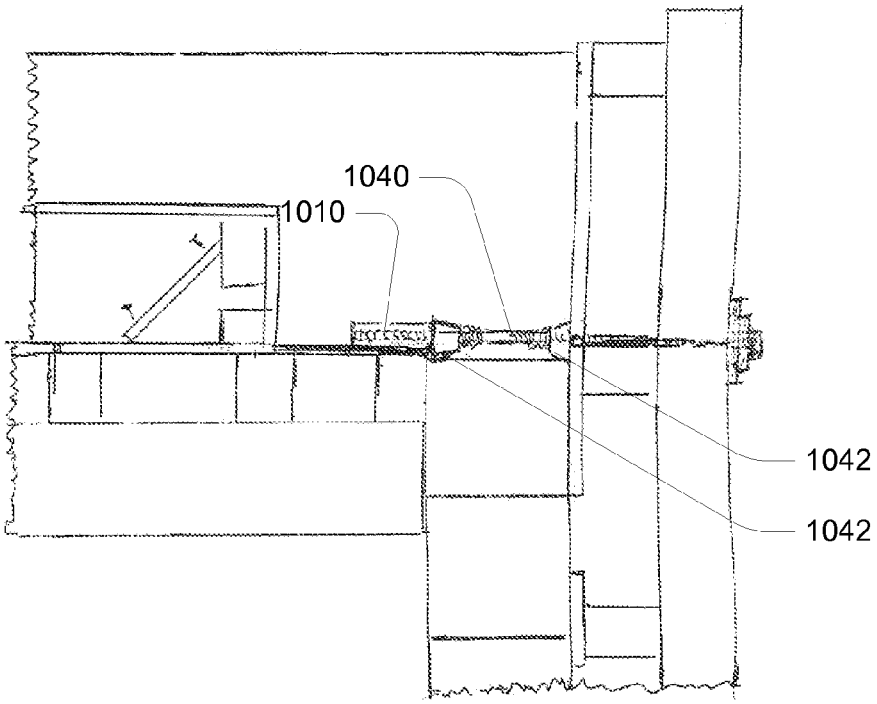
FIG. 10A is a side elevation view of the device according to the invention, shown in use.
Figure 11D:
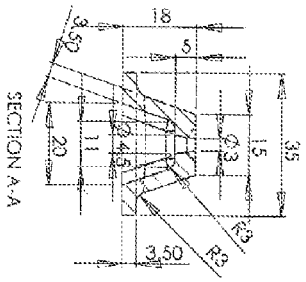
FIG. 11D is a sectional end view of the device of FIG. 11A.
Figure 11B:
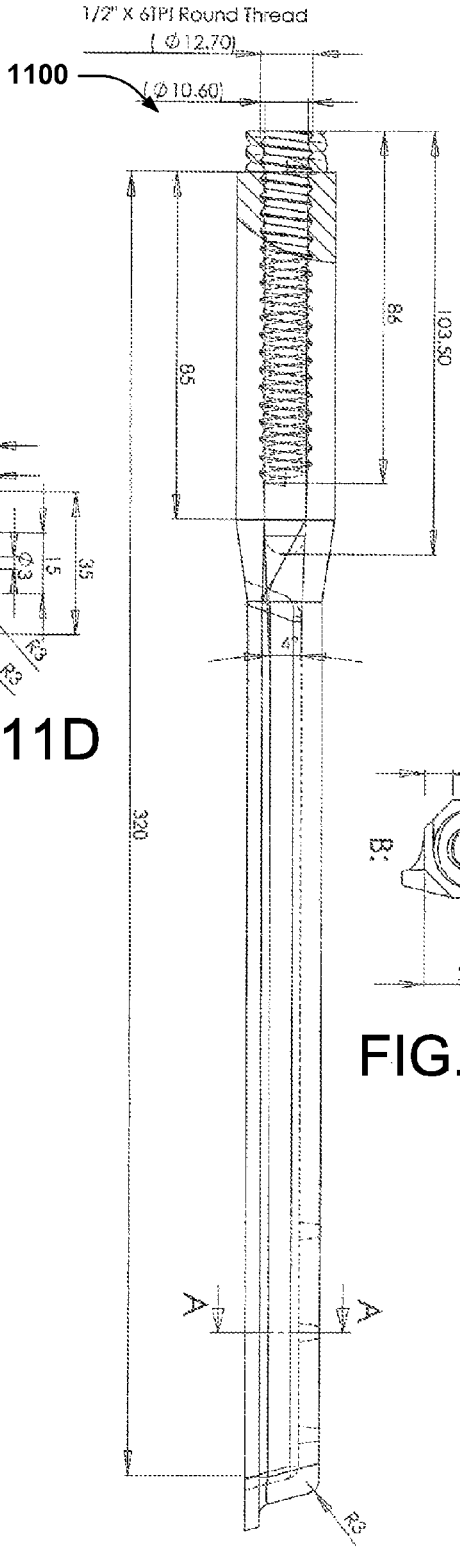
FIG. 11B is side elevation view of the device of FIG. 11A.
Figure 11C:
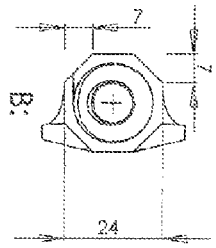
FIG. 11C is a end view of the device of FIG. 11A.
Figure 11A:
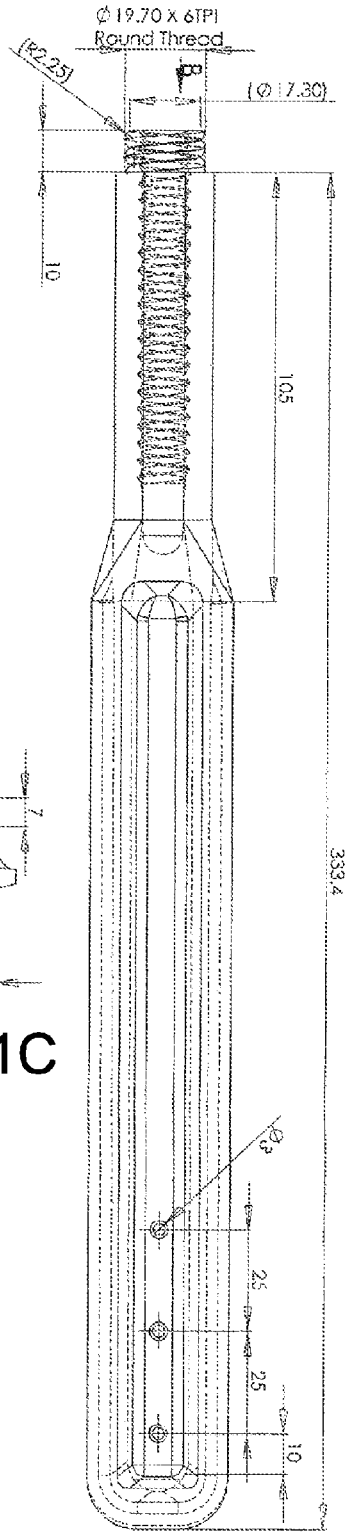
FIG. 11A is a plan view of a device according to the invention.

FIG. 10 shows an example embodiment of the device 1010 used in construction of a concrete wall. The device is connected to the coil spring tie 1040, which is further engaged at the other side of the device. In this instance plastic cones 942 (for example 35 mm or 25 mm) are coupled to the tie 940. The device is abuttingly engaged with a corner or an edge of formwork.

FIG. 11A through 11D show a dimensioned embodiment of a device 1100 (shown in millimeters) similar to device 100.

Figure 12A:
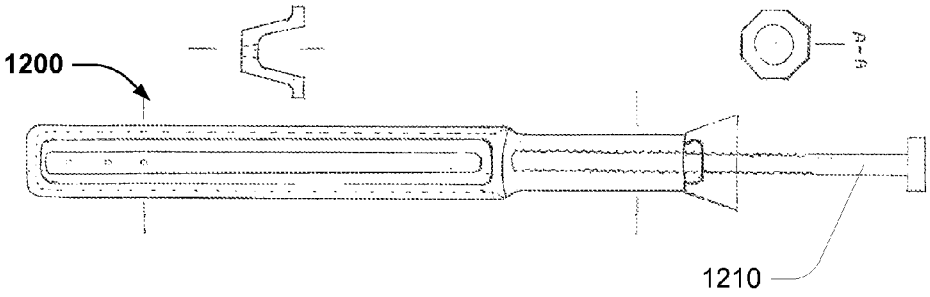
FIG. 12A is a plan view of a device according to the invention, shown threadedly engaged to a bolt.
Figure 12B:
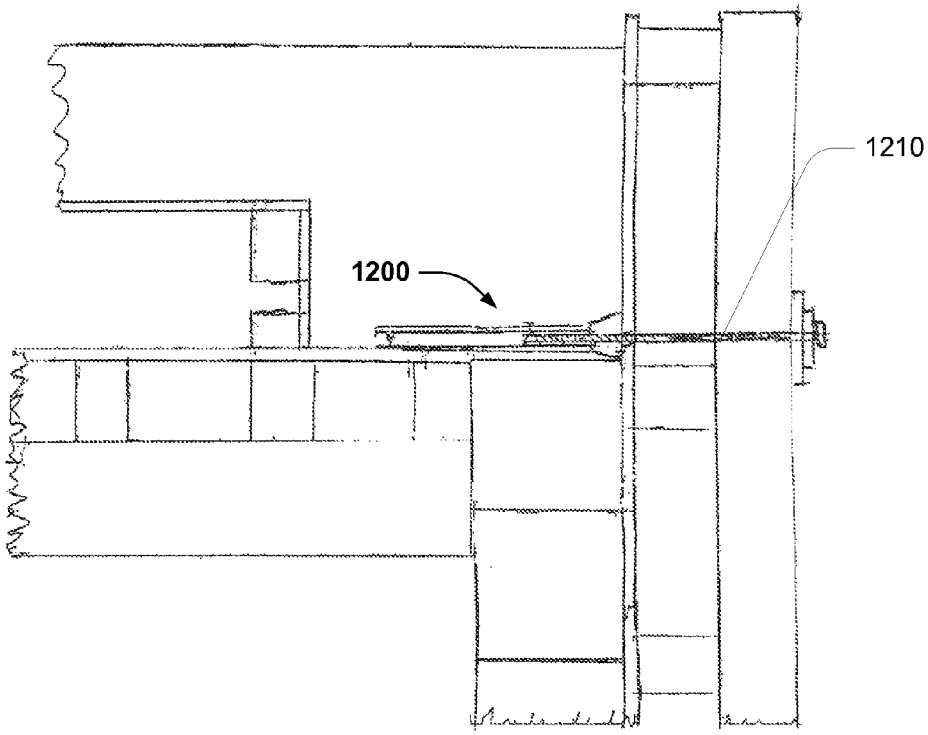
FIG. 12B is a side elevation view of the device of FIG. 12A, shown in use.

FIG. 12A and FIG. 12B shows an embodiment of a device 1200 (similar to device 100) threadedly engaged to a bolt 1210. The device is engaged to a substantially horizontal portion of formwork (as best shown in FIG. 12B).

It will be appreciated that the disclosed adapter spacer and tie devices can reduce cost and material usage, as there is less need to brace the outside beam side, edgeboard, top of wall etc.

It will be appreciated that the illustrated devices can be used as an adaptor, spacer and/or tie in concrete construction formwork.

Although the invention has been described with reference to specific examples, it will be appreciated by those skilled in the art that the invention may be embodied in many other forms.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

Similarly, it is to be noticed that the term coupled, when used in the claims, should not be interpreted as being limitative to direct connections only. The terms "coupled" and "connected", along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical, or that two or more elements are not in direct contact with each other but yet still co-operate or interact with each other.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

As used herein, unless otherwise specified the use of terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader, or with reference to the orientation of the structure during nominal use, as appropriate. Similarly, the terms "inwardly" and "outwardly" generally refer to the orientation of a surface relative to its axis of elongation, or axis of rotation, as appropriate.

Similarly it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

The claims defining the invention are as follows:

1. A device for use with formwork in concrete construction, the device comprising:

an elongate body having a first end and a second end; a first end surface at the first end of the body having an longitudinally directed bore that defines a first aperture in the first end surface; the bore having a threaded periphery for enabling threaded engagement with a formwork coupling element received axially through the first aperture;

two longitudinal side protrusions, the longitudinal side protrusions being respectively located at opposite sides of the body, each of the side protrusions further defining a sidewall that extends upwardly outwardly with respect to the body for defining a recess there between;

an endwall proximal to the second end of the body; the end-wall interconnects the sidewall of the each side protrusion;

wherein the sidewalls and end-wall have a continuous peripheral outwardly-extending flange; and wherein, in use, the formwork coupling element is received axially through the first aperture and is threadedly engaged to the bore for releasably coupling the body to the formwork.

2. The device according to claim 1, further comprising a substantially planar lower base portion for engaging a formwork surface.

3. The device according to claim 2, further comprising a first fastening element for releasably fastening the device to the formwork surface.

4. The device according to claim 3, wherein the first fastening element includes a plurality of fixing apertures for receiving nails to releasably fasten the device to a substantially horizontal portion of formwork; the fixing apertures being located in about the body through each of the side protrusions.

5. The device according to claim 1, in combination with a building comprising concrete, wherein the device is substantially encapsulated in the concrete; and wherein the device can be used as an anchor point when set in concrete.

6. The device according to claim 1, further comprising a protrusion for abutting engagement with a corner or an edge of formwork.

7. The device according to claim 1, wherein the bore extends axially into the body and is adapted for threaded engagement with a threaded rod or bolt.

8. The device according to claim 7, wherein the device further comprising a second aperture at a second end of the body; and the second aperture is adapted for receiving a formwork coupling element.

9. The device according to claim 8, wherein the bore defines a longitudinal through passage that forms the second aperture.

10. The device according to claim 1, wherein the bore is a through bore that extends axially through the body for defining a second aperture at the second end of the body, the second aperture being adapted to enable threaded engagement of a second formwork coupling element for releasably coupling the body to the formwork.

11. The device according to claim 8, further comprising a protrusion for abutting engagement with a corner edge of a formwork.

12. The device according to claim 8, wherein the device is integrally formed.

13. The device according to claim 12, wherein the device is constructed from plastics.

14. The device according to claim 10, wherein the device is constructed from plastics; wherein in use, the device is substantially encapsulated in the concrete with the first end surface exposed to thereby enable the first aperture to define an anchor point in the concrete when set.

* * * * *